United States Patent [19]

Hirayama et al.

[11] 4,037,548

[45] July 26, 1977

[54] KNIFE OPERATING DEVICE FOR SEWING MACHINES

[75] Inventors: Tetsuro Hirayama, Chofu; Kousuke Yuyama; Yoshihiko Matsuura, both ofTokyo, all of Japan

[73] Assignee: Juki Co., Ltd., Tokyo, Japan

[21] Appl. No.: 519,243

[22] Filed: Oct. 30, 1974

[30] Foreign Application Priority Data

| | | |
|---|---|---|
| Nov. 1, 1973 | Japan | 48-123222 |
| Nov. 8, 1973 | Japan | 48-125748 |
| Nov. 8, 1973 | Japan | 48-125749 |

[51] Int. Cl.[2] ..... D05B 37/00

[52] U.S. Cl. ..... 112/123 R; 112/128; 112/221

[58] Field of Search ..... 112/122, 123, 128, 129, 112/130, 218 R, 221

[56] References Cited

U.S. PATENT DOCUMENTS

| | | | |
|---|---|---|---|
| 334,114 | 1/1886 | Eastwood | 112/128 |
| 1,946,558 | 2/1934 | Weis | 112/128 |
| 2,493,735 | 1/1950 | Alifano et al. | 112/128 |
| 2,538,272 | 1/1951 | Reimer et al. | 112/123 |
| 3,167,042 | 1/1965 | Bono | 112/123 |
| 3,450,081 | 6/1969 | Rabinow | 112/221 |
| 3,645,221 | 2/1972 | Hirayama | 112/221 |

*Primary Examiner*—H. Hampton Hunter
*Attorney, Agent, or Firm*—Arnold S. Weintraub

[57] ABSTRACT

A knife operating device for sewing machines includes a needle stub pivotally mounted to the front part of a rocking arm. The rocking arm intersects with a needle stub guiding bar and is pivotally mounted and its rear end. A knife holder is, also, connected to the rocking arm and is guided so as to be movable with the needle stub.

14 Claims, 9 Drawing Figures

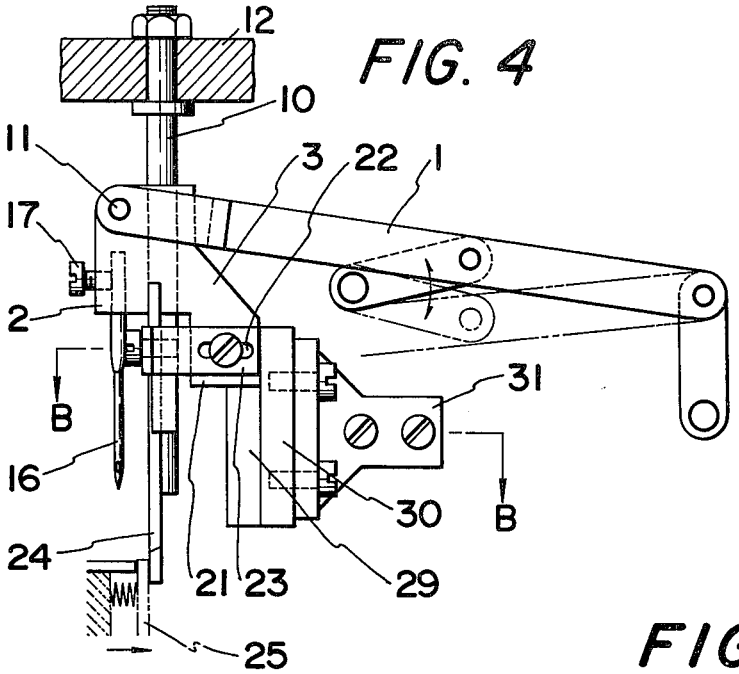
FIG. 4
FIG. 6
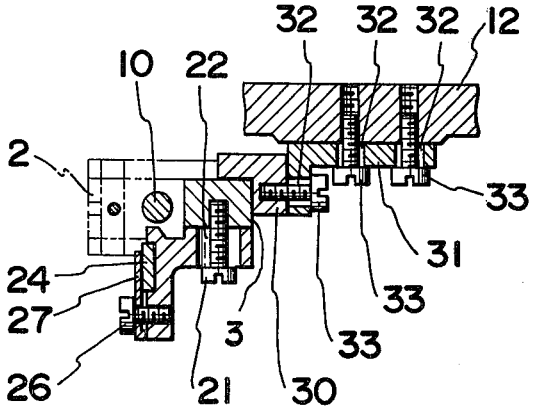
FIG. 5
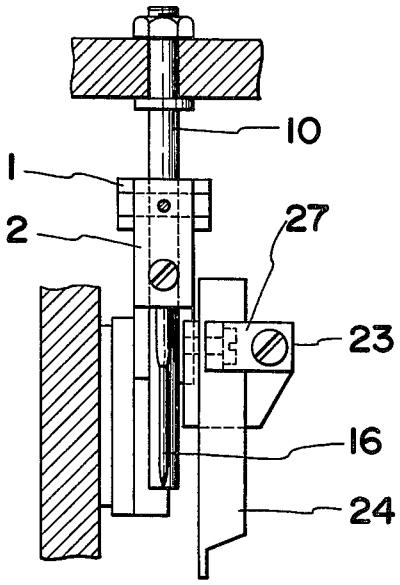

KNIFE OPERATING DEVICE FOR SEWING MACHINES

BACKGROUND OF THE INVENTION

1. Field of the Invention

This invention relates to knife operating devices for sewing machines. More particularly, the invention unifies a needle operating means and a knife operating means into one system, to, thereby, omit the assembling of a separate device for the operation of the knife and to, thus, simplify the structure of the sewing machine.

2. Prior Art

Generally, a sewing machine provided with a knife has a knife operating means in addition to a needle operating means. These needle operating means and knife operating means are formed of racks and links of separate systems connected with respective pulley shafts.

Therefore, the sewing machine having a knife mechanism is complicated in the structure; is troublesome to maintain and service, is large in the volume and is disadvantageous to make small. Also, there are a large number of component parts in making such a machine, and is, therefore, very high in cost and difficulty in manufacture.

In view of such problems as are mentioned above of a sewing machine provided with a knife, the present inventors have invented a novel concrete means for solving various problems caused in relation to such sewing machine by combining a knife operating means with a needle operating means so as to be made one system.

OBJECTS OF THE INVENTION

An object of the present invention is to assemble a knife operating mechanism into a needle operating mechanism so that the needle operating mechanism and knife operating mechanism are one system, the structure of the sewing machine having the knife operating mechanism being simplified and the machine being smaller.

Another object of the present invention is to apply an approximately linear motion mechanism utilized in the operation of a needle to the operation of a knife.

A further object of the present invention is to inhibit unnecessary vibrations produced by the weight and the structure of the operating means in the part operated by the unified operating mechanism and particularly in the part for carrying the knife so that the sewing machine operation may be smooth.

A still further object of the present invention is to provide a structure for reducing as much as possible the stress which is given by the knife carrying part subjected to a large cutting stress to the knife operating mechanism unified with the needle operating mechanism.

These objects can be attained with the device of the present invention. Various embodiments of the device attaining these objects are shown in the accompanying drawings in which:

BRIEF DESCRIPTION OF THE DRAWING

FIG. 4 is an elevational view of an embodiment wherein only a needle stub guiding bar is used as a guiding bar so that a part for carrying a knife may be driven integrally with the needle stub through the needle stub by being connected with the needle stub through a connecting rod and the part for carrying the knife may be guided with a guiding piece;

FIG. 5 is a side view of the same;

FIG. 6 is a sectioned plan view on line B—B in FIG. 4;

DESCRIPTION OF THE PREFERRED EMBODIMENTS

The mechanism common to the three kinds of embodiments shown in the above drawing of the present invention is of a needle stub 2 and a knife holder 3 which is a part for carrying a knife as connected directly or indirectly with a link-shaped rocking arm 1 of a so-called Scott Russell's type so that the knife holder 3 may be rocked vertically and reciprocally by a driving means of one system together with the needle stub 2.

Figure 1:
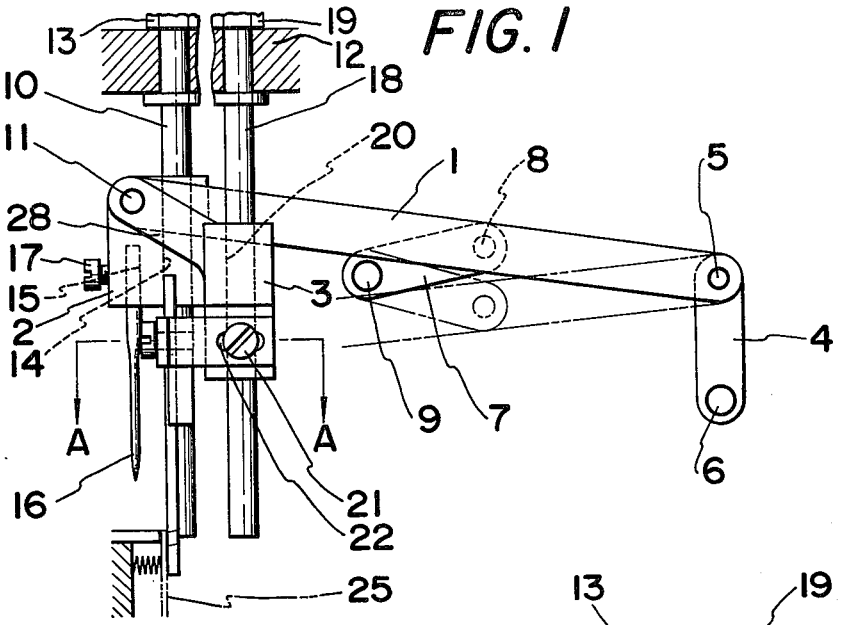
FIG. 1 is an elevation view of an embodiment wherein a needle stub guiding bar and a guiding bar guiding a part for carrying a knife are used so that the part for carrying the knife may be driven integrally with the needle stub through the needle stub by being connected with the needle stub through a connecting rod.

As in FIG. 1, a rocking arm 1 is connected at the rear end with a link 4 through a pin 5 and the link 4 is pivoted at the other end to a proper place of a machine frame through a pin 6. The rocking arm 1 is connected in the middle part with a driving rod 7 through a pin 8 and the driving rod 7 is carried at the other end with a driving shaft 9 making a half rotation. With the half-rotating operation of the driving shaft 9, the driving rod 7 will reciprocally rotate from the position shown by the solid line to the position shown by the two-dot chain line so that the rocking arm 1 may also reciprocally move from the position shown by the solid line to the position shown by the two-dot chain line. Thus, the rocking arm 1 rocks vertically and reciprocally and makes, at the front end, a so-called approximately linear motion. This motion at the front end of this rocking arm 1 describes a very microscopically curved-shaped locus which can be considered to be a linear motion for a needle driving device for a sewing machine and is generally used as such.

This rocking arm 1 is forked at the front end and a needle stub 2 which can move up and down, as guided by a needle stub guiding bar 10, is pivoted in the fork through a pin 11.

The needle stub guiding bar 10 is fixed at the upper end to a sewing machine frame 12 with a nut 13 and suspended so as to intersect with the rocking arm 1. The bar 10 is inserted through a guiding hole 14 so that the needle stub 2 may move up and down along the needle stub guiding bar 10. Further, a needle receiving hole 15 is provided on the lower surface of the needle stub 2 and a needle 16 is inserted into said needle receiving hole 15 and is fixed with a set screw 17.

A guiding bar 18 for a knife holder is arranged in parallel with the needle stub guiding bar 10 and is fixed with a nut 19 so as to be suspended. This guiding bar 18 is of the same length as of the needle stub guiding bar 10 and is suspended outside the front side of the rocking arm 1.

Various other means of guiding this knife holder than the here described guiding bar can be adopted. A knife holder 3 is guided movably up and down by the guiding bar 18 inserted into a guiding hole 20 made in the knife holder 3 and is fitted with an L-shaped knife stand 23 so as to be adjustable in the sidewise direction with a set screw 21 screwed on the front side and a slot 22 passing it.

In the drawings, 24 is a knife fitted to the knife stand and 25 is a lower knife provided in the part of a needle plate so as to correspond to the knife 24. The structure of the knife stand 23 is shown particularly in FIG. 3.

Figure 3:
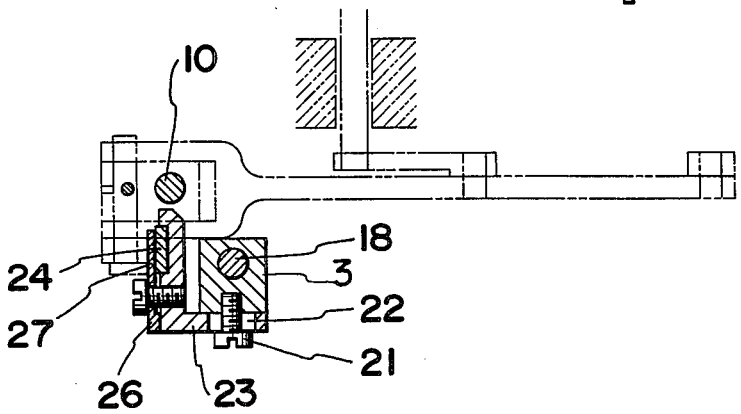
FIG. 3 is a sectioned plan view on line A—A in FIG. 1.

In FIG. 3, the knife stand 23 is fixed by screwing a set screw 21 into the knife holder 3 through a slot 22 made in the knife stand 23 and has on the side a receiving groove for receiving and stabilizing the knife 24. The knife 24 is fitted in the receiving groove and is pressed and held with a knife pressing piece 27 pressed against the knife stand 23 with a fastening screw 26.

Figure 2:
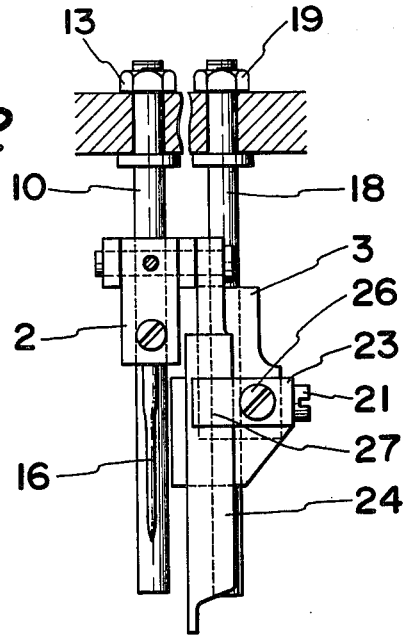
FIG. 2 is a side view of the same.

As in FIGS. 1 and 2, such knife holder 3 is pivoted and engaged with the end part of the pin 11 pivoting the needle stub 2 to the rocking arm 1 in the front part of a connecting rod 28 extended in the sidewise upper direction. This manner can be definitely observed mostly in FIG. 2.

It should further be noted that the knife holder 3 can be projected on the side opposite the side on which the needle of the needle stub is provided without the need for the connecting rod 28. When so projected the knife holder 3 can be fixed on the front side by means such as a pin.

In the embodiment shown in FIGS. 4 and 6, there is only one guiding bar and a guiding piece is used for the guide for the knife holder.

That is to say, as in FIG. 4, a needle stub 2 is pivoted with a pin 11 at the front end of a rocking arm 1 and is guided in the same manner as in the above described embodiment by a needle stub guiding bar 10.

The needle stub 2 is projected on the side opposite the part holding a needle 16 so as to be a knife holder 3. This knife holder 3 is formed to be substantially integral with the needle stub 2 and may be substantially of such form as is shown in FIG. 4. A knife holder made of a member different from a needle stub 2 can be closely fixed to the needle stub 2.

A knife stand 23 is fixed on the front side of the knife holder 3 with a slot 22 made in it and a set screw 21 inserted through the slot. Needless to say, the knife stand 23 can be adjusted sidewise in the fitting position with the slot 22.

As in FIGS. 5 and 6, a knife 24 is fixed to this knife stand 23 with a knife pressing piece 27 and fastening screw 26 in the same manner as in the above described embodiment.

The end surface of the knife holder in the projected part on the side opposite the side on which the needle 16 is fitted of the needle stub 2 is made at right angles with the respective surfaces on the front side and back side. Both the back side and the end surface are very smoothly finished.

The knife holder 3, which is integral with the needle stub 2, is securely supported and guided with a guiding piece 30. The guide piece 30 is substantially L-shaped for the above mentioned back side and end surface and vertically has a long receiving surface 29. The receiving surface 29 is smoothly finished. The guiding piece 30 is fixed to an L-shaped fitting piece 31 fixed to a sewing machine frame 12. The fitting piece 31 has slots 32 and is fixed with set screws 33 passed through the slots 33 so as to be adjustable sidewise. The guiding piece is also fixed with the slot 32 and set screw 33 so as to be adjustable forward and rearward in the position in the same manner.

Thus, the guiding piece 30 securely receives the needle stub 2 and knife holder 3 and guides them in their moving direction. Thereby the knife 24 integral with the needle stub 2 is well supported and guided and irregular vibrations by the stress produced in the case of cutting cloth are inhibited by the guiding piece 30.

Figure 7:
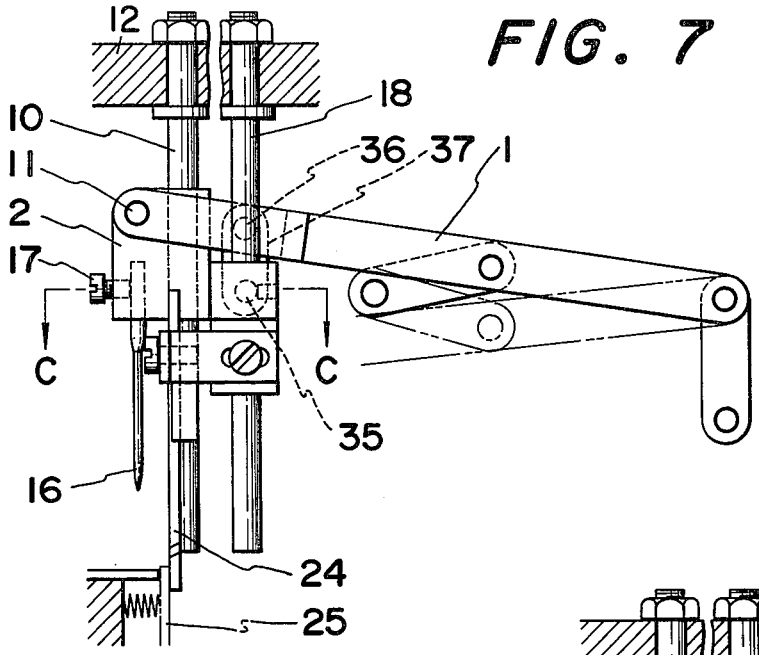
FIG. 7 is an elevational view of an embodiment wherein a needle stub guiding bar and a guiding bar guiding a part for carrying a knife are used so that the part for carrying the knife may be driven in a position in which the stress moment is smaller than in the needle stub by being connected with a rocking arm in a part nearer to the force point than the needle stub.
Figure 8:
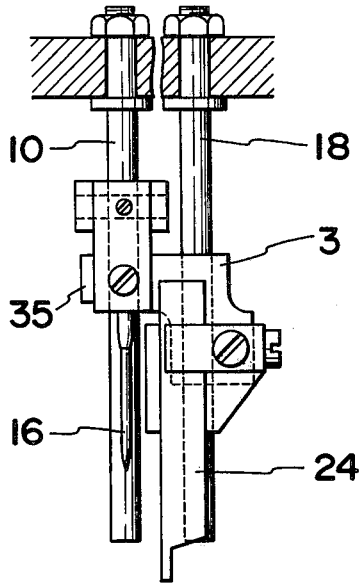
FIG. 8 is a side view of the same.
Figure 9:
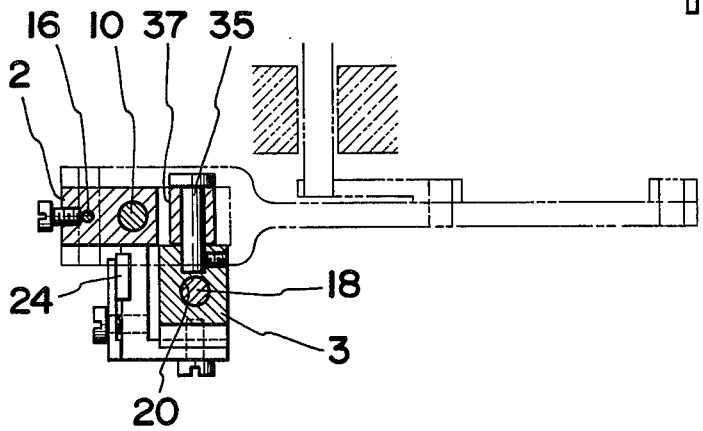
FIG. 9 is a sectioned plan view on line C—C in FIG. 7.

In FIGS. 7 to 9, there is shown an embodiment wherein a needle stub guiding bar 10 and a knife holder guiding bar 18 are used and a knife holder 3 is connected with a rocking arm 1 separate from a needle stub so that the stress of cutting cloth on the knife is not greatly translated to the rocking arm 1.

To achieve this, the rocking arm 1 is forked to be long enough at the front end, the needle stub guiding bar 10 fixed to the machine frame 12 is suspended and held in the fork. The same needle stub 2 as described with reference to the embodiment shown in FIG. 1 is pivoted with a pin 11. The needle stub 2 is guided by the needle stub guiding bar 10. The other formations are also the same as is shown in FIG. 1 and, therefore, the detailed explanation shall be omitted.

As seen in FIGS. 8 and 9, the knife holder guiding bar 18 is suspended and fixed to the machine frame 12 so as to intersect with the outside of the front side of the forked front end of the rocking arm 1.

As in FIG. 9, the knife holder 3 is guided by the guiding bar 18 and holds a knife 24 in the same manner as in the embodiment of FIG. 1. Therefore, the detailed explanation of this point shall also be omitted.

As in FIGS. 8 and 9, the knife holder 3 is provided with a bracket pin 35 to project so as to intersect with the rocking arm 1 on its lower side.

On the other hand, as in FIG. 7, a pin 36 for a link is provided across the above mentioned forked part in the front part of the rocking arm 1. A link 37 is pivoted to this pin 36 and is connected with the above mentioned bracket pin 35. This connecting manner is clearly shown in FIG. 7.

In this embodiment, the knife holder 3 is linked with the rocking arm 1 in a part nearer to the force point of the rocking arm than the needle stub. Therefore, the knife holder 3 is moved up and down together with the needle stub 2 by the rocking arm 1 but the stress of cutting cloth on the knife 24 is reduced by reducing the moment of the force. Further, the link connecting part describes a locus which is largely curved by the part near the rotary pivotal point of the rocking arm. However, the knife holder 3 is allowed, by the link 37, to make a linear motion according to the knife holder guiding bar 18. Thus, the link 37 absorbs vibrations relative to the rocking arm 1 of the knife holder 3. The stress on the knife holder 3 is reduced effectively and, therefore, the operation of the machine becomes smooth.

When the knife holder 3 is connected with the rocking arm 1 in the part nearer to the force point than the needle stub 2, the rotary curvature radius of said connecting part of said rocking arm will become smaller and therefore it is difficult to linearly drive the knife holder.

Thus, the rotary curve motion of the rocking arm must be absorbed by using such means as the above described link 37. It is further contemplated, that the link could be replaced by a link system wherein the knife holder is connected with the rocking arm through a groove formed in the direction intersecting at right angles with the direction of the vertical motion of the knife holder with a connecting piece movable in the width of the groove fitted therein. However, in the simplicity of the formation, the above mentioned link system is the best.

Having, thus, described the invention what is claimed is:

1. A knife operating device for a sewing machine, comprising:

a. a rocking arm having a front end and a rear end, and being pivotally mounted at its rear end to the sewing machine, b. a needle stub guiding bar intersecting the rocking arm at the front end of the rocking arm, the bar being connected to the frame of the sewing machine, c. a needle stub mounted on the needle stub guiding bar and being guided thereby, d. a knife holder, e. means connecting the knife holder to the rocking arm, and f. means operatively connected to the rocking arm to simultaneously move both the needle stub and the knife holder in response to the movement of the rocking arm.

2. The device of claim 1 wherein:

a. the rocking arm has a forked front end, b. the needle stub guiding bar intersecting the rocking arm at the forked front end to hold the guide bar, c. the needle stub is pivotally connected to the rocking arm through a pin traversing the forked front end of the rocking arm, and d. a connecting rod is connected to the knife holder at one end thereof and to the pin at the other end thereof, the connecting rod being connected to the pin outside the forked front end of the rocking arm, the connecting rod defining the means for connecting the knife holder to the rocking arm and comprising the means for simultaneously moving the needle stub and the knife holder.

3. The device of claim 2 which further comprises:

a knife holder guiding bar, the knife holder guiding bar being substantially parallel to the needle stub guiding bar and connected to the sewing machine frame, the knife holder being mounted on the knife holder guiding bar.

4. The device of claim 1 wherein:

the needle stub and the knife holder are integrally formed thereby connecting the knife holder to the rocking arm, the device further comprising: a guiding piece having a receiving surface, the receiving surface being parallel to the needle stub guiding bar, the guiding piece receiving and supporting the knife holder.

5. The device of claim 1 which further comprises:

A knife holder guiding bar disposed in parallel to the needle stub guiding bar, the knife holder guiding bar being connected to the sewing machine frame and having the knife holder fitted thereonto, the knife holder guiding bar guiding the knife holder, and a link interconnecting the knife holder to the rocking arm, the link defining the means for connecting the knife holder to the rocking arm.

6. A knife operating device for a sewing machine comprising:

a. a rocking arm having a front end and a rear end, and being pivotally mounted at its rear end to the sewing machine, b. a needle stub guiding bar intersecting the rocking arm at the front end of the rocking arm, the bar being connected the frame of the sewing machine, c. a needle stub mounted on the needle stub guide bar and being guided thereby, d. a knife holder connected to the needle stub such that the knife holder is precluded from movement relative to the needle stub, and wherein the needle stub is pivotally connected to the rocking arm to simultaneously move both the needle stub and the knife holder in response to the rocking arm.

7. The device of claim 6 which further comprises:

a. a connecting rod, the rod connecting the needle stub and the knife holder.

8. The device of claim 6 wherein:

a. the rocking arm has a forked front end, d. the needle stub guiding bar intersects the rocking arm at the forked front end to hold the guide bar, c. the needle stub is pivotally connected to the rocking arm through a pin traversing the forked front end of the rocking arm, and d. the connecting rod is connected to the pin outside the forked front end of the rocking arm.

9. The device of claim 8 which further comprises:

A knife holder guiding bar, the knife holder guiding bar being substantially parallel to the needle stub guiding bar, the knife holder guiding bar being connected to the sewing machine frame, and wherein the knife holder is mounted on the knife holder guiding bar.

10. The device of claim 6 wherein:

the needle stub and the knife holder are integrally formed.

11. The device of claim 10 which further comprises:

a guiding piece having a receiving surface, the receiving surface being parallel to the needle stub guiding bar, the guiding piece receiving and supporting the knife holder.

12. A knife operating device for a sewing machine, comprising:

a. rocking arm having a front end and a rear end, and being pivotally mounted at its rear end to the sewing machine, b. a needle stub guiding bar intersecting the rocking arm at the front end of the rocking arm, the bar being connected to the frame of the sewing machine, c. a needle stub mounted on the needle stub guiding bar and being guided thereby, the needle stub being pivotally connected to the rocking arm, d. a knife holder connected to the needle stub such that the knife holder is precluded from movement relative to the needle stub, e. a link extending between the knife holder and the rocking arm and being pivotally connected thereto, and wherein the knife holder and the needle stub move simultaneously in response to the movement of the rocking arm.

13. The device of claim 12 wherein the link absorbs the rotary curve motion of the rocking arm and is connected to the rocking arm nearer to the force point of the rocking arm than the needle stub.

14. The device of claim 1 wherein the needle stub and knife holder move linearly reciprocatingly along the single rocking arm, the rocking arm being of the type wherein its rear end rotates and its front end approximates a linear movement.

* * * * *